US006474606B1

(12) United States Patent
Cheng

(10) Patent No.: US 6,474,606 B1
(45) Date of Patent: Nov. 5, 2002

(54) GOLF BAG TILTING STRUCTURE

(76) Inventor: Wen-Chien Cheng, P.O. Box 453, Taichung (TW)

( * ) Notice: Subject to any disclaimer, the term of this patent is extended or adjusted under 35 U.S.C. 154(b) by 0 days.

(21) Appl. No.: 10/098,385

(22) Filed: Mar. 18, 2002

(51) Int. Cl.[7] ..... A63B 55/00

(52) U.S. Cl. ..... 248/96; 248/169; 248/688; 206/315.3

(58) Field of Search ..... 248/96, 169, 688, 248/165; 206/315.3, 315.7, 315.8

(56) References Cited

U.S. PATENT DOCUMENTS 1,181,007 A * 4/1916 Henneberg ..... 248/96
1,982,388 A * 11/1934 Huehn ..... 248/96
4,798,357 A * 1/1989 Cho ..... 248/96
5,597,144 A * 1/1997 Lee ..... 248/96
5,718,401 A * 2/1998 Walters ..... 248/150
6,220,433 B1 * 4/2001 Kang ..... 206/315.7
6,298,988 B1 * 10/2001 Wen-chien ..... 206/315.7

* cited by examiner

*Primary Examiner*—Kimberly Wood

(57) ABSTRACT

A golf bag tilting structure comprises a fixed tube fastened at the bottom end with a bag bottom disk, and a movable tube fastened at the top end with a bag top edge such that the bottom end of the movable tube is slidably fitted into the top end of the fixed tube. The fixed tube is linked with one or more tilting rods which are pivoted at the top end with the bag top edge. As the bag top edge is exerted on by an external force, the bottom end of the movable tube is forced to slide to compress a spring which is located in the top end of the fixed tube. The tilting rods swivel away from the bag body to support the golf bag slantingly on the ground.

3 Claims, 7 Drawing Sheets

GOLF BAG TILTING STRUCTURE

BACKGROUND OF THE INVENTION

1. Field of the Invention

The present invention relates generally to a golf bag, and more particularly to a tilting structure of the golf bag.

2. Description of Related Art

The conventional golf bag is generally provided with a tilting structure to enable the golf bag to be put on the ground slantingly. However, the conventional golf bag tilting structure is limited in function in that it does not hold the golf bag securely on the ground.

BRIEF SUMMARY OF THE INVENTION

The primary objective of the present invention is to provide a golf bag with a tilting structure comprising an adjustable rod member to enable the distance between the top and the bottom of the golf bag to be adjusted automatically at the time when the golf bag is tilted on the ground. The adjustable rod member is formed of a fixed tube and a movable tube which is movably received in the fixed tube. The movable tube is fastened at the top end with the top edge of the golf bag such that the bottom end of the movable tube is slidably received in the top end of the fixed tube. The fixed tube is connected at the bottom end with the bottom disk of the golf bag by a joint, such a ball-and-socket joint.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
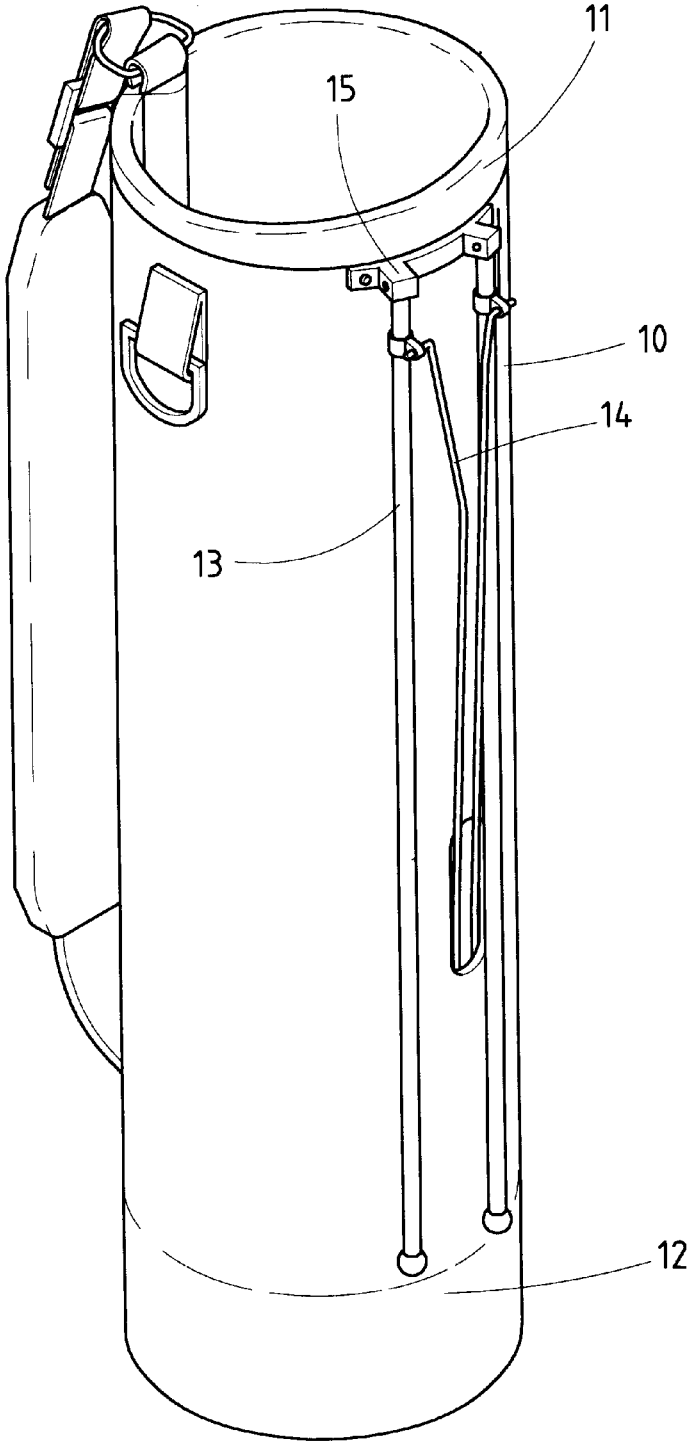
FIG. 1 shows a perspective view of a golf bag of the present invention.
Figure 2:
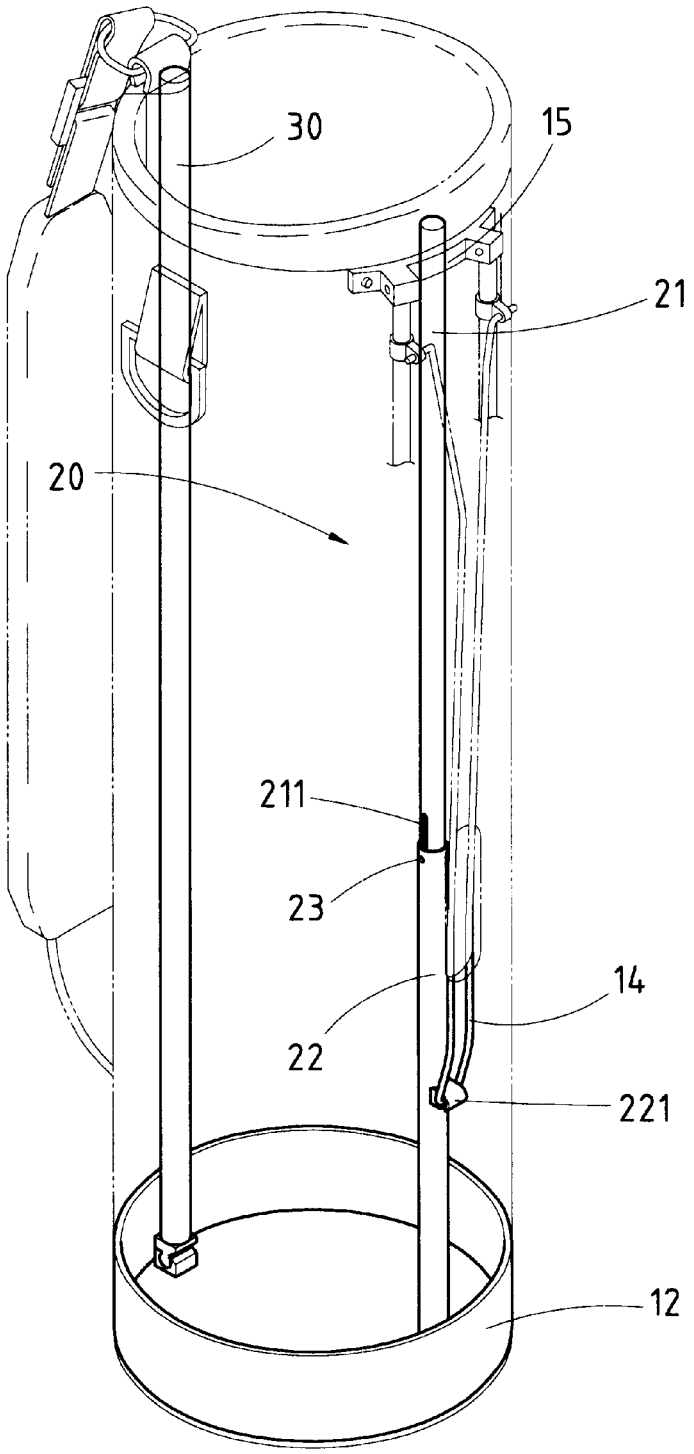
FIG. 2 shows a schematic view of a tilting structure of the golf bag of the present invention.

As shown in FIGS. 1–8, a golf bag embodied in the present invention comprises a bag body 10 of a cylindrical construction, a support rod 30, and a tilting structure which is formed of a bag top edge 11, a bog bottom disk 12, one or two tilting rods 13, a link piece 14, and an adjustable rod member 20. The support rod 30 is disposed in the interior of the bag body 10 such that the top end of the support rod 30 is fastened with the bag top edge 11, and that the bottom end of the support rod 30 is fastened which the bag bottom disk 12 of the bag body 10.

The bag top 11 is provided with a fastening piece 15 attached thereto. The tilting rods 13 are pivotally fastened at the top end with the fastening piece 15. The tilting rods 13 are linked with the adjustable rod member 20 by the link piece 14.

The adjustable rod member 20 is formed of a movable tube 21 and a fixed tube 22. The movable tube 21 is fastened at the top end with the bag top edge 11 such that the bottom end of the movable tube 21 is slidably fitted into the top end of the fixed tube 22. The fixed tube 22 is fastened at the bottom end with the bottom disk 12 of the bag body 10. The preferred embodiment of the present invention is provided with a ball-and-socket joint which is formed by a ball 228 of the bottom end of the fixed tube 22 and a socket 128 of the bottom disk 12, ad illustrated in FIG. 6. The ball-and-socket joint allows the bottom end of the fixed tube 22 to move limitedly in any directional, ad illustrated by the dotted lines in FIG. 6.

Figure 3:
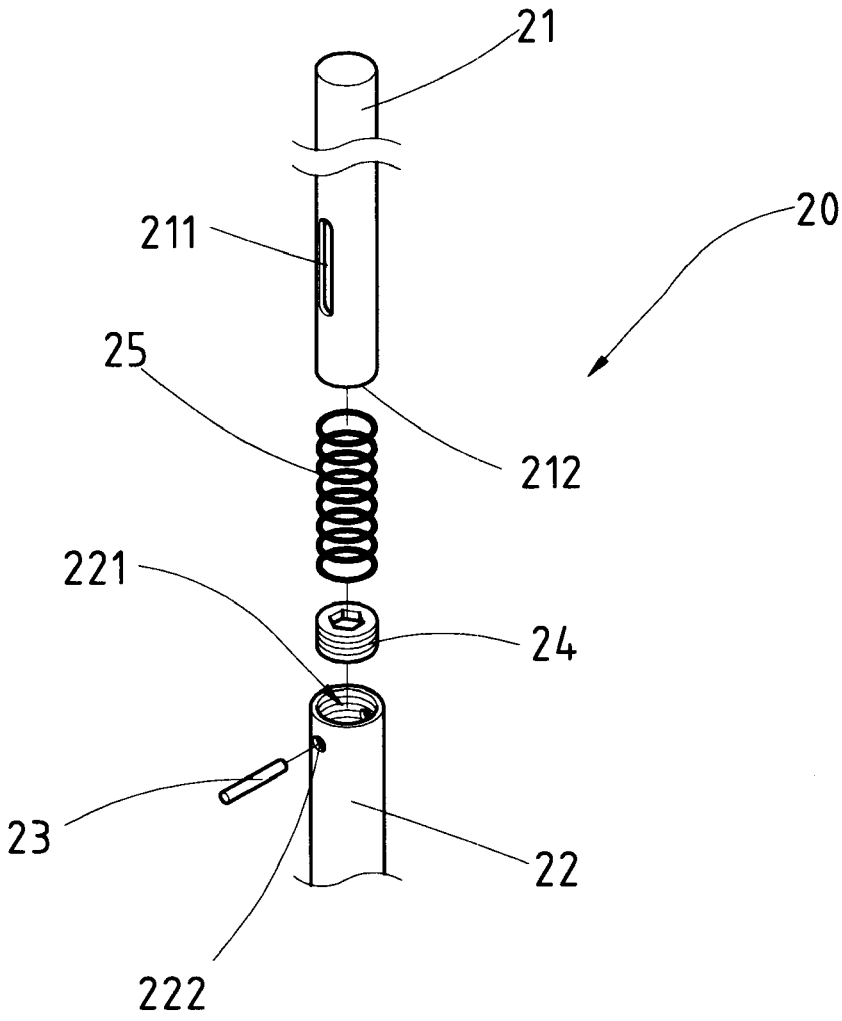
FIG. 3 shows a partial exploded view of the adjustable rod member of the tilting structure of the golf bag of the present invention.
Figure 4:
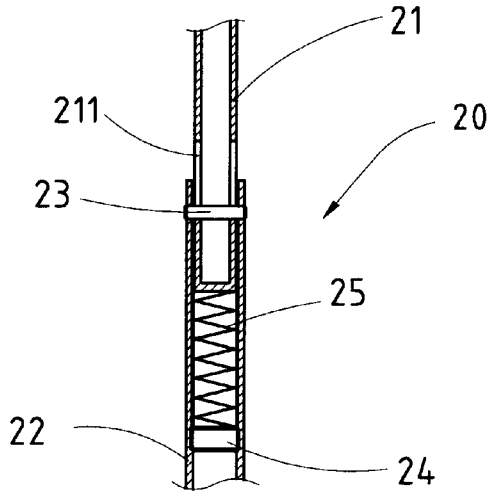
FIG. 4 shows a longitudinal sectional view of the adjustable rod member of the tilting structure of the present invention at work.
Figure 5:
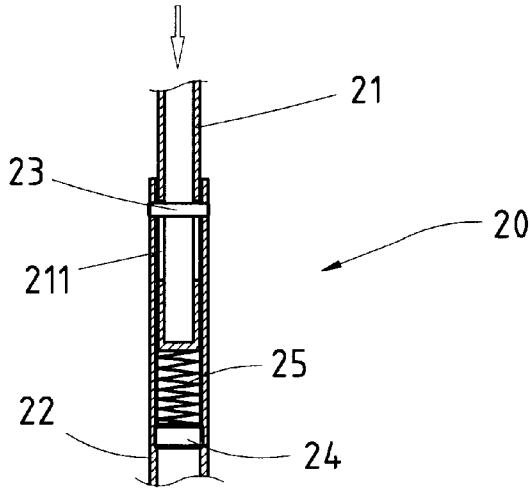
FIG. 5 shows another longitudinal sectional view of the adjustable rod member of the tilting structure of the present invention at work.
Figure 6:
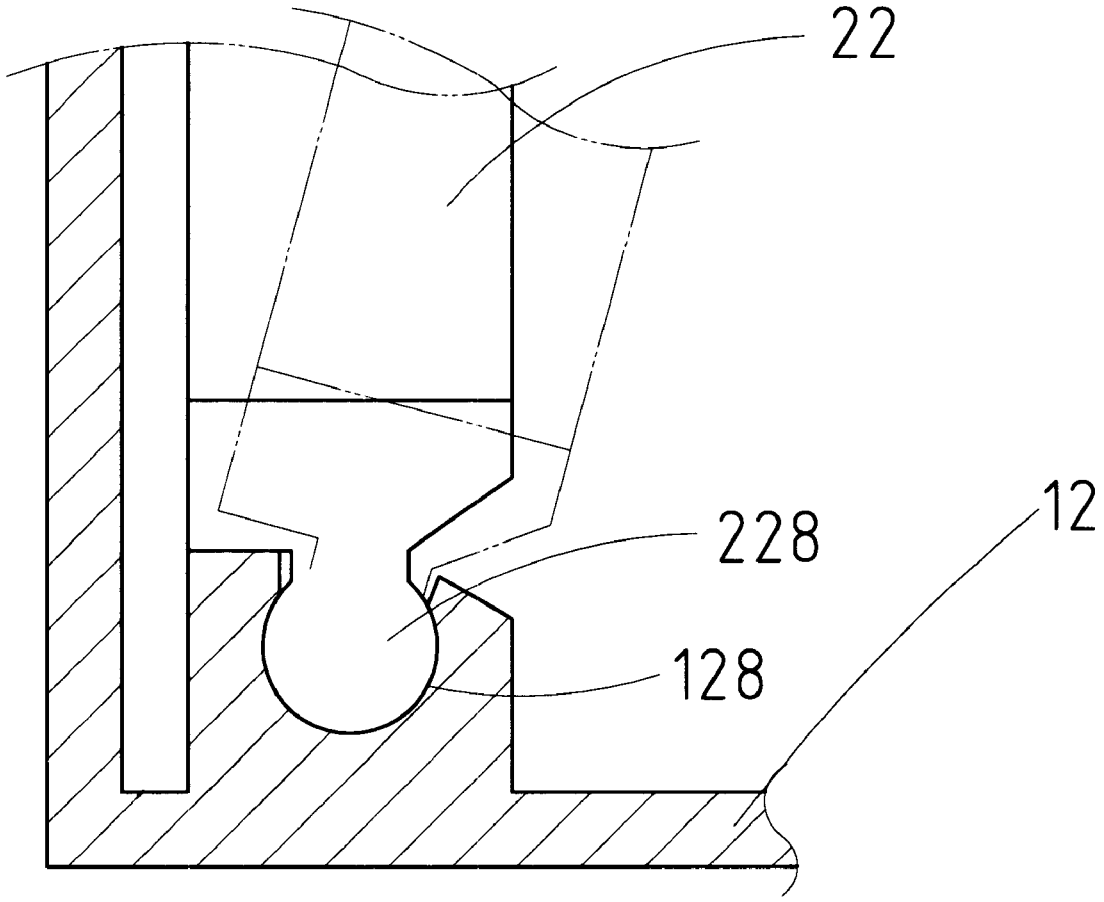
FIG. 6 shows a sectional schematic view of the ball-and-socked joint by which the bottom end of the fixed tube of the adjustable rod member is connected with the bottom of the golf bag of the present invention.
Figure 7:
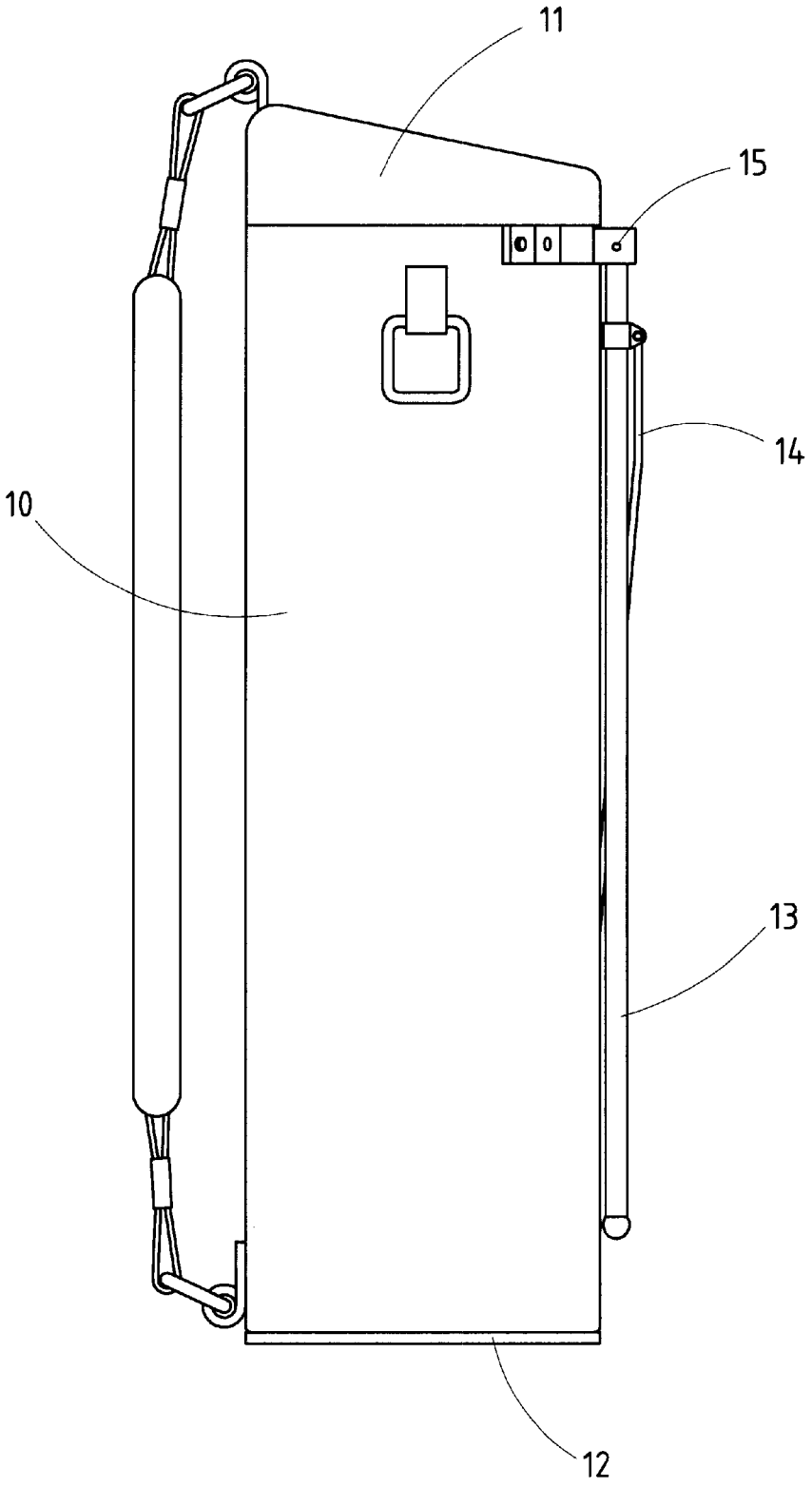
FIG. 7 shows a schematic view of the golf bag of the present invention which is placed uprightly on the ground.

As shown in FIGS. 3–5, the adjustable rod member 20 further comprises a plug 24 and a spring 25, which are fitted into the top end of the fixed tube 22. The bottom end of the spring 25 is stopped by the plug 24. The bottom end of the movable tube 21 is urged by the top end of the spring 25. The bottom end of the movable tube 21 is provided with two position confining holes 211, whereas the top end of the fixed tube 22 is provided with two pin holes 222. The bottom end of the movable tube 21 is received in the top end of the fixed tube 22 in conjunction with a pin 23 which is put through the pin holes 222 of the fixed tube 22 and the position confining holes 211 of the movable tube 21. The position confining holes 211 of the movable tube 21 have a predetermined length and extends in the longitudinal direction of the movable tube 21. The bottom end of the movable tube 21 has a contact portion 212, which is urged by the top end of the spring 25. The sliding range of the movable tube 21 in the fixed tube 22 is corresponding to the length of the position confining holes 211 of the movable tube 21.

The fixed tube 22 is provided with a retaining piece 221 fastened therewith for retaining the link piece 14 which is used to link the fixed tube 22 of the adjustable rod member 20 with the tilting rods 13.

Figure 8:
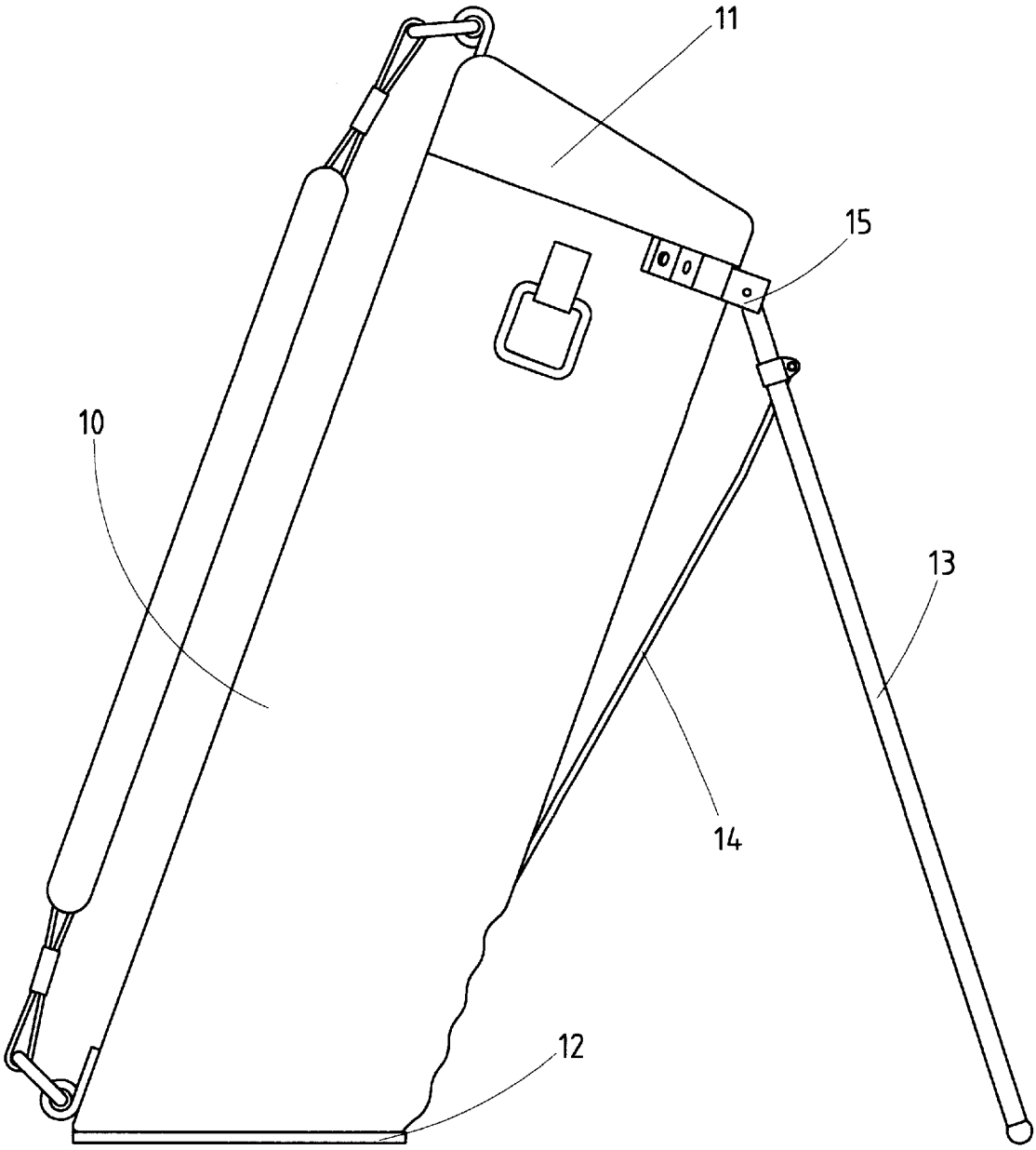
FIG. 8 shows a schematic view of the golf bag of the present invention which is tilted on the ground.

When the bag body 10 is tilted by the tilting rods 13, the spring 25 is compressed by the bottom end of the movable tube 21, as shown in FIG. 5. Accordingly, the bag body 10 can be tilted by an external force exerting on the bag top edge 11, thereby causing the bottom end of the movable tube 21 to slide further into the top end of the fixed tube 22 such that the spring 25 is compressed by the contact portion 212 of the movable tube 21. As a result, the tilting rods 13 spread out such that the bottom ends of the tilting rods 13 are rested on the ground, so as to tilt the bag body 10 on the ground, as shown in FIG. 8.

It must be noted here that the two pin holes 222 of the fixed tube 22 are opposite in location to each other, and that the two position confining holes 211 of the movable tube 21 are opposite in location to each other.

I claim:

1. A golf bag comprising:

a cylindrical bag body;

a support rod disposed in the interior of said bag body; and a tilting structure for tilting said bag body, said tilting structure comprising:

a bag top edge disposed at a top end of said bag body and provided with a fastening piece attached thereto;

a bag bottom disk disposed at a bottom end of said bag body;

one or more tilting rods pivoted at a top end with said fastening piece of said bag top edge;

an adjustable rod member fastened at a top end with said bag top edge, and at a bottom end with said bag bottom disk; and a link piece for linking said adjustable rod member and said tilting rods;

wherein said adjustable rod member comprises:

a fixed tube fastened at a bottom end with said bag bottom disk and provided at a top end with two pin holes opposite in location to each other;

a plug disposed in the top end of said fixed tube;

a spring disposed in the top end of said fixed tube such that a bottom end of said spring is rested on said plug;

a movable tube fastened at a top end with said bag top edge and provided at a bottom end with two position confining holes opposite in location to each other, said two position confining holes having a length and extending in the longitudinal direction of said movable tube, said movable tube being fitted slidably at a bottom end thereof into the top end of said fixed tube in conjunction with a pin which is put through said pin holes of said fixed tube and said position confining holes of said movable tube whereby the bottom end of said movable tube is caused to slide to compress said spring at such time when said bag top edge is exerted on by an external force, thereby causing said tilting rods to swivel away from said bag body such that bottom ends of said tilting rods are rested on a surface, and that said bag body is rested slantingly on the surface.

2. The golf bag as defined in claim 1, wherein said fixed tube is provided with a retaining piece fastened therewith for retaining said link piece.

3. The golf bag as defined in claim 1, wherein said fixed tube is provided at the bottom end with a ball; wherein said bag bottom disk is provided with a socket; wherein the bottom end of said fixed tube is movably connected with said bag bottom disk such that said ball of the bottom end of said fixed tube is movably received in said socket of said bag bottom disk.

* * * * *